US006497814B1

(12) United States Patent
Alexander et al.

(10) Patent No.: US 6,497,814 B1
(45) Date of Patent: Dec. 24, 2002

(54) APPARATUS FOR CLEANING A SWIMMING POOL WATER FILTER

(76) Inventors: Ken Alexander, 1457 Classic Oak Rd. West, Jacksonville, FL (US) 32225; Robert Henderson, 159 Eleventh St., Atlantic Beach, FL (US) 32233

( * ) Notice: Subject to any disclaimer, the term of this patent is extended or adjusted under 35 U.S.C. 154(b) by 0 days.

(21) Appl. No.: 09/883,617

(22) Filed: Jun. 18, 2001

(51) Int. Cl.[7] ..... B01D 27/00; B01D 41/00

(52) U.S. Cl. ..... 210/108; 210/169; 210/232; 210/416.2; 210/420; 210/425; 4/490; 134/170; 134/199

(58) Field of Search ..... 210/169, 420, 210/424, 425, 416.2, 97, 108, 106, 194, 196, 232; 4/490; 134/22.12, 199, 170, 152

(56) References Cited

U.S. PATENT DOCUMENTS 2,686,139 A 8/1954 Lamb et al.
2,985,178 A 5/1961 Christensen, Jr.
3,820,552 A 6/1974 Lang et al.
4,417,596 A 11/1983 Pahlën
4,652,369 A * 3/1987 DePolo et al.
4,709,717 A 12/1987 Ranningan et al.
4,834,883 A * 5/1989 Lake
4,836,702 A 6/1989 Allen
4,995,749 A 2/1991 Gornik
5,292,074 A * 3/1994 Clark et al.
5,366,021 A 11/1994 Coleman
5,989,419 A * 11/1999 Dudley et al.

* cited by examiner

*Primary Examiner*—Joseph W. Drodge
*Assistant Examiner*—Terry K. Cecil
(74) *Attorney, Agent, or Firm*—Clifford A. Poff

(57) ABSTRACT

A water pump normally used in a system circulating pool water through a filter cartridge 26 is used to clean the filter cartridge by coupling a 3-way or inline valve 32 and a tee 36 in the piping 12 between the pump 16 and the filter. In a first valve position, the filter housing receives the entire water output from the pump, and in a second position, the entire water output of the pump is diverted to a flexible hose 52 secured to a first water discharge wand 58. A circular ring-shaped manifold 64 with an array of discharge apertures 66 directs streams of water radially outward into the filter cartridge in a direction opposite the normal flow of water for hydraulically flushing debris from the filter cartridge. A second wand with a C-shaped manifold (FIG. 5) is then connected to the hose and used to direct water streams onto the outer periphery of the filter cartridge.

16 Claims, 5 Drawing Sheets

APPARATUS FOR CLEANING A SWIMMING POOL WATER FILTER

CROSS-REFERENCE TO RELATED APPLICATIONS

Not applicable

BACKGROUND OF THE INVENTION

1. Field of the Invention

The present invention relates to the cleaning of a filter cartridge used to remove debris from water, and more particularly, to a combination of parts for using water of a swimming pool filtration system for flushing debris from a water filter after use to clean debris from pool water.

2. Description of the Prior Art

It is a well-known practice to circulate water of a swimming pool or spa through a filter to remove entrained solids. It is essential to clean debris entrapped on the water permeable fibrous surface of the water filter at regular intervals to maintain an effective performance of the water filter. A water filter for a residential swimming pool typically takes the form of a filter housing containing a removable filter cartridge. Commercial swimming pools are typically provided with a water filter having spaced apart filter grids in a water chest. The cartridge type filters and filter grids are all per se well known in the art and produce an increase to the back pressure in the piping connected to the water pump due to a reduced flow space for water caused by entrapped debris on the filtration surface. It is a common practice to use an existing spray nozzle used for household chores and connected to a water hose for using water supplied by municipal water authority for washing debris from the water filter. The size of the central opening in a cartridge type filter for delivery of filtered water forms a restraint precluding effective access of a water stream from an existing spray nozzle to produce the cleaning action by water flow opposite to the flow of swimming pool water through the cartridge. The filter cleaning operation is time consuming and the water pressure is often inadequate to clean the filter throughly.

As disclosed in U.S. Pat. Nos. 3,820,552 and 4,417,596 it is known in the art to move a cartridge type filter in an elongated annular sleeve provided with a serial of water discharge holes directed to the outer peripheral of the filter cartridge. The water discharge holes communicate with an external annulus for supplying water from a water main by an interconnected hose. The streams of water discharged from the elongated annular sleeve impact against the pleated surface of the filter cartridge in the same direction as the flow of water from the swimming pool. The water flow functions to free the debris lying on the surface of the filter by suspending the debris in the water draining from the surface of the filter. Water passed through the filter is lost to the cleaning process because the streams of water are directed.

Accordingly, it is an object of the present invention to provide a construction of a filter cleaning device to provide streams of cleaning water for passage through a water filter in a direction that is opposite to the flow of water during the filtration operation.

It is a further objection of the present invention to provide a water filtering system using the water pump thereof to provide the source of pool water at high pressure and high volume than usually available from a municipal water authority for more effective cleaning of a pool filter which can be in the form of a filter cartridge or filter grids.

It is another object of the present invention to provide a water discharge wand having a manifold provided with an array of water discharge orifices sufficient in a number and orifice diameter to accommodate the pressurized flow of pool water formed by a water pump of a pool filtering system.

SUMMARY OF THE INVENTION

According to the present invention there is provided in a water filtering system having a pump coupled in piping for a circulating water of a body of water such as swimming pool water through a filter cartridge in one flow direction to a centrally located discharge chamber for delivery from the filter cartridge, the combination of: a valve coupled in the piping between the pump and the filter housing, the valve having a first position wherein the filter housing receives the entire water output from the pump and a second position for diverting the entire water output of the pump from the filter housing; a conduit for receiving the entire water output from the pump when the valve is in the second position; and a first water discharge wand joined to the conduit for receiving the water output from the conduit, the first water discharge wand having an elongated handle with an internal duct communicating with a circular ring-shaped manifold having an array of water discharged apertures for directing streams of water radially outward into a filter cartridge in a direction opposite to the flow of water through the filter cartridge when in a filter housing for hydraulically flushing debris from a filter cartridge using the entire pressurized water flow of the pump.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
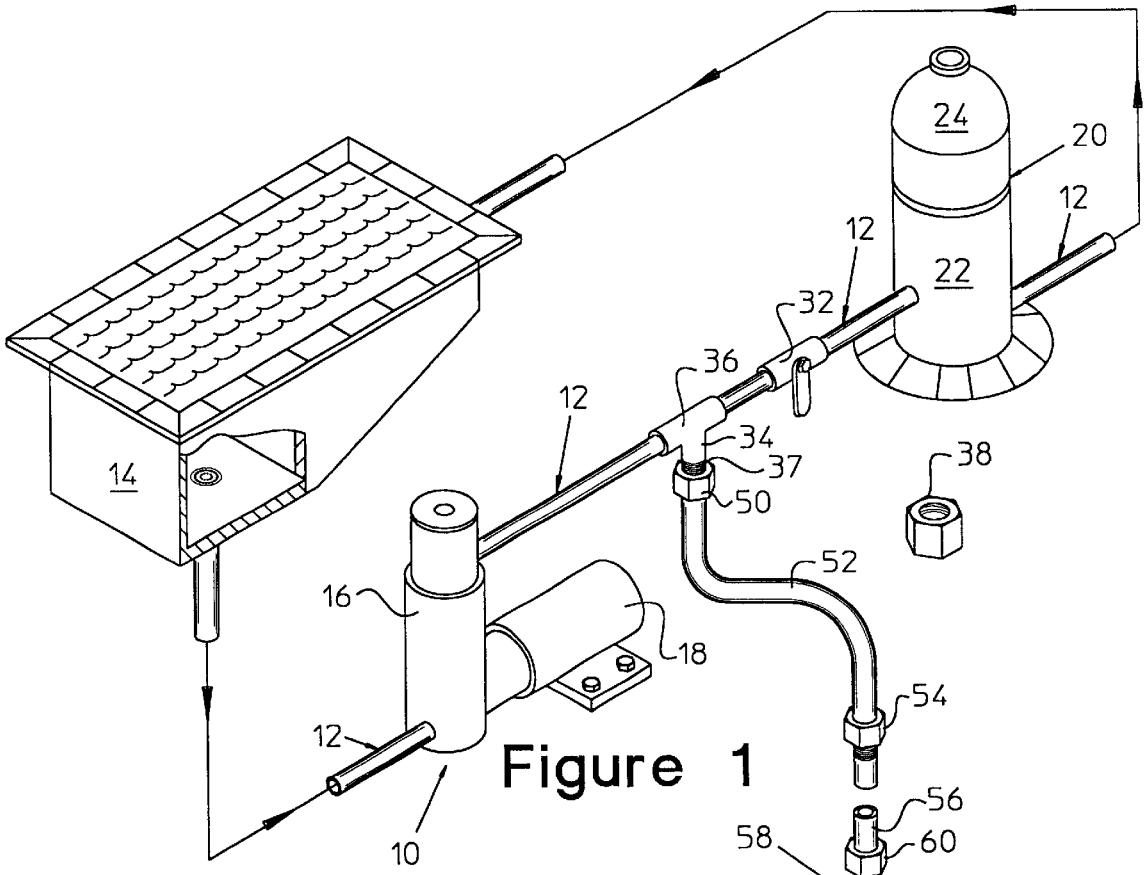
FIG. 1 is a schematic illustration of a swimming pool water filtering system incorporating the features of the present invention.

In FIG. 1 there is illustrated a water filtration system 10 which includes piping 12 for conducting the flow of water from a swimming pool 14 using a water pump 16 driven by an electric motor 18 to a water pool filter 20 and then provide a return flow of filtered water to the swimming pool. The water pool filter 20 is per se well known in the art and essentially includes an annular housing 22 with a removable cover 24 to allow removal of an annular filter cartridge 26, which is shown in FIG. 1 at a location external to the water pool filter 20. The filter cartridge is made up of pleated filter fabric 28 arranged as a circular ring pattern and mounted between circular rings 30. Pool water entering the water pool filter flows through the pleated filter fabric 28 to a hollow central annular chamber between the circular rings 30, one of which is centered on a discharged duct when the annular filter cartridge 26 is in the water pool filter for the return flow of filter water by the piping 12.

Figure 2:
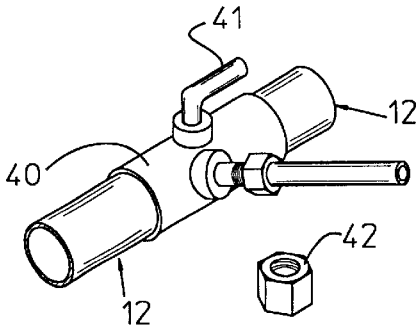
FIG. 2 is an illustration of an alternative use of a 3-way valve in a swimming pool water filtering system incorporating the features of the present invention.

According to the present invention a diverter valve 32 preferably a ball valve is placed in line in the piping 12 to divert the entire flow of water from the water pool filter to a third duct 34 of a tee fitting 36. As shown, the tee fitting 36 is located between the water pump 16 and the diverter valve 32. The third duct 34 fitted with a threaded nipple 37 normally closed by an end cap 38 to prevent water loss during the time when the pool filter is operated in the usual manner for cleaning pool water. An alternative arrangement of parts for providing a diverted water flow from the piping 12 is shown in FIG. 2 and consists of installing a three-way valve 40 in the pipping 12 between the water pump 16 and the water pool filter 20. The three way valve 40 is controlled by a lever 41 for selectively changing the flow of water to a third duct of the valve which is normally closed by an end cap 42.

When it is desired to clean the annular filter cartridge 26, the pump motor 18 is turned OFF and the filter cartridge 26 is removed from the housing 22 of the pool filter 20. The end cap 38 is removed from the threaded nipple 37 and then the threaded nipple 37 is joined to a threaded connector 50 of a suitable length of a flexible hose 52. The free end of the hose 52 contains a threaded connector 54 used to form a water tight connection with an elongated handle 56 of a radius wand 58.

Figure 3:
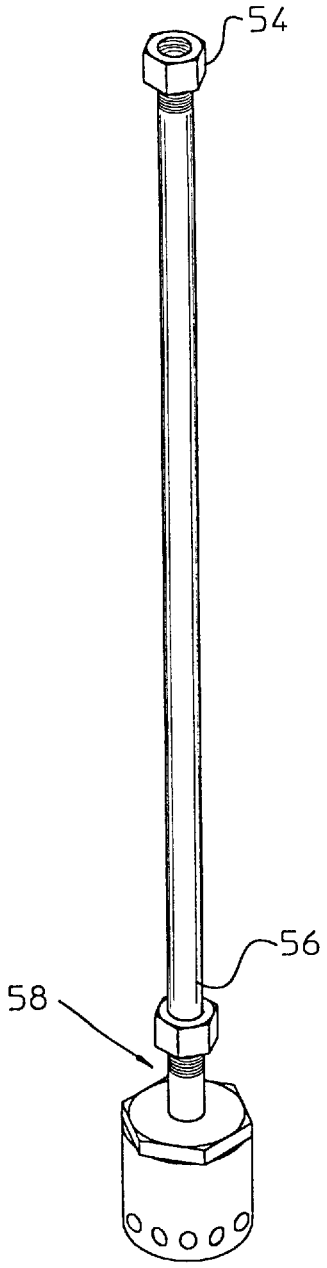
FIG. 3 is a plan view of a radius wand according to the present invention.
Figure 4:
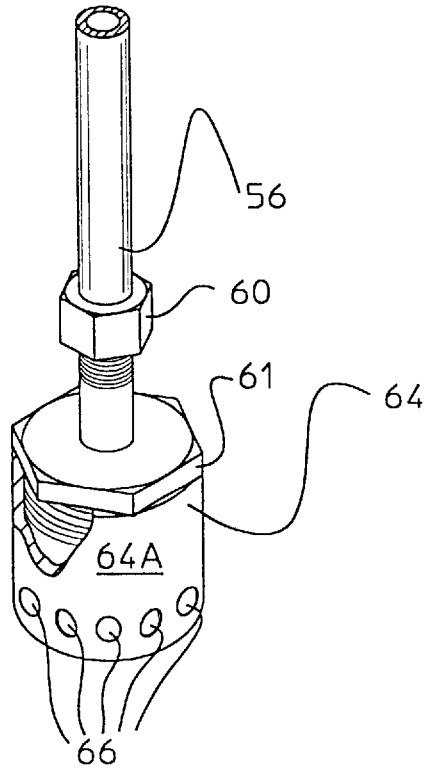
FIG. 4 is an enlarged view partly in section of the radius wand shown in FIG. 3.

As shown in FIGS. 3 and 4, the extended end of the handle 56 is joined with a threaded connector 60 to form a water tight threaded connection with a disc shaped end wall 61 of a circular ring manifold 64. This threaded connection allows removal of the handle for cleaning debris from the manifold. The outer annular wall 64A of the manifold 64 contains an array of water discharge apertures 66 equally spaced about wall 64A and lying in a common plane which is perpendicular to the longitudinal axis of the flow space for water in the handle for directing streams of water radially outward from wall 64A onto the pleated filter fabric 28 of the filter cartridge. The external diameter of the annular wall 64A is slightly smaller than the inside diameter of the hollow central annular chamber, identified by reference numeral 27 in FIG. 1, of the annular filter cartridge 26. The handle 56 is used by the operator to linearly and rotatably displace the manifold 64 along the hollow central annular chamber 27 of the filter cartridge 26 after the electric motor 18 is turned ON. The entire supply of pressurized water delivered by the water pump 16 to the radius wand 58 forms water streams emerging radially outward from the apertures 66 to impact and flood the surface of the pleated filter fabric 28. The electric motor 18 and water pump 16 for a residential swimming pool are designed to pressurize the pool water typically to a pressure between 15 PSI to 20 PSI at a water volume of 60 gallons per minute using a one horse power pump motor and conventionally sized piping 12. The number and diameter of the aperture 66 are chosen to maintain the conventional flow rate and water volume. An example of suitable apertures is thirty apertures with a diameter of 0.078125"(5/64"). The pressurized impact of the water streams with the filter fabric 38 is sufficient to produce a reverse flow of water through the filter fabric and hydraulically wash entrain debris from the filter fabric.

Figure 5:
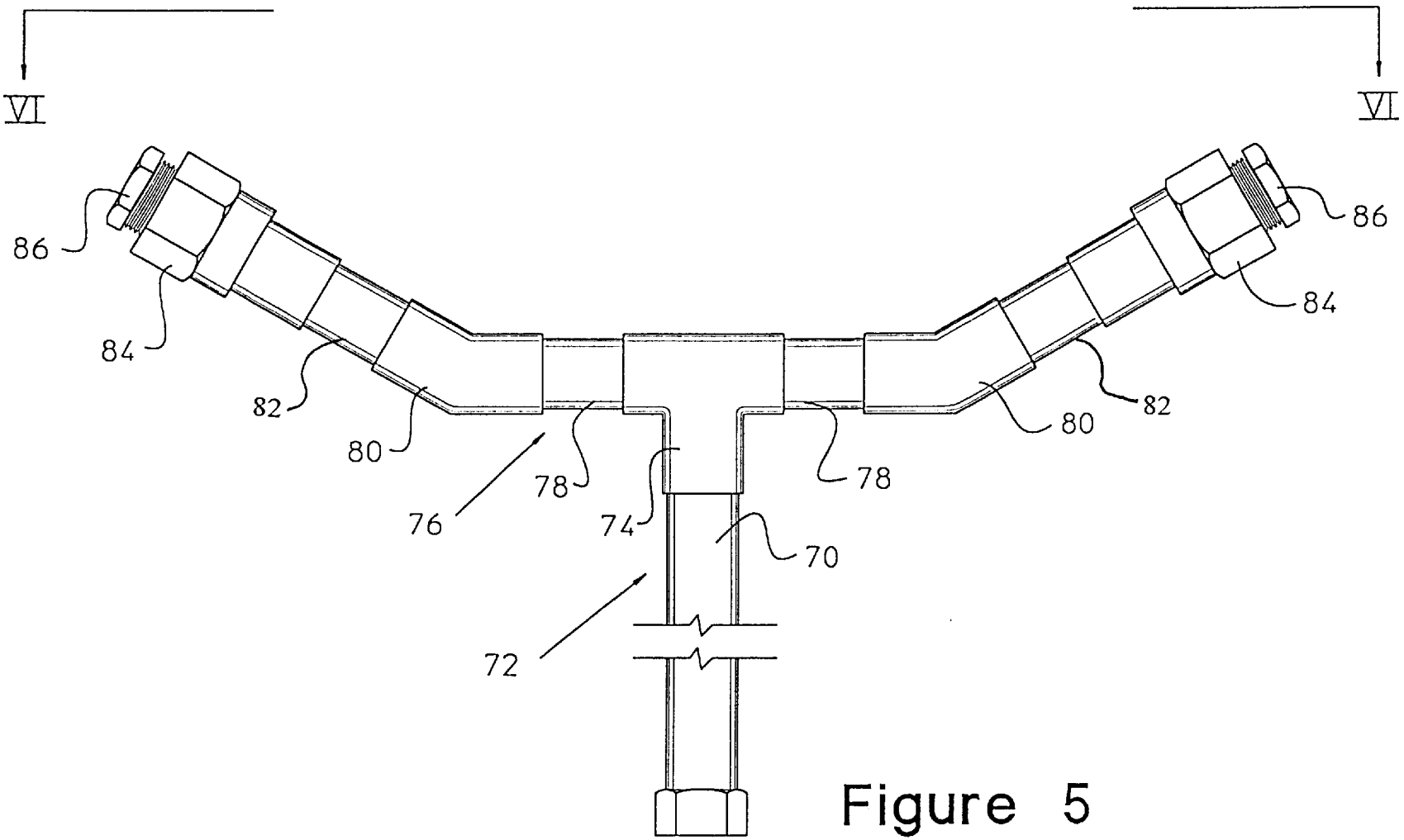
FIG. 5 is a plan view of a rinsing wand according to the present invention.
Figure 6:
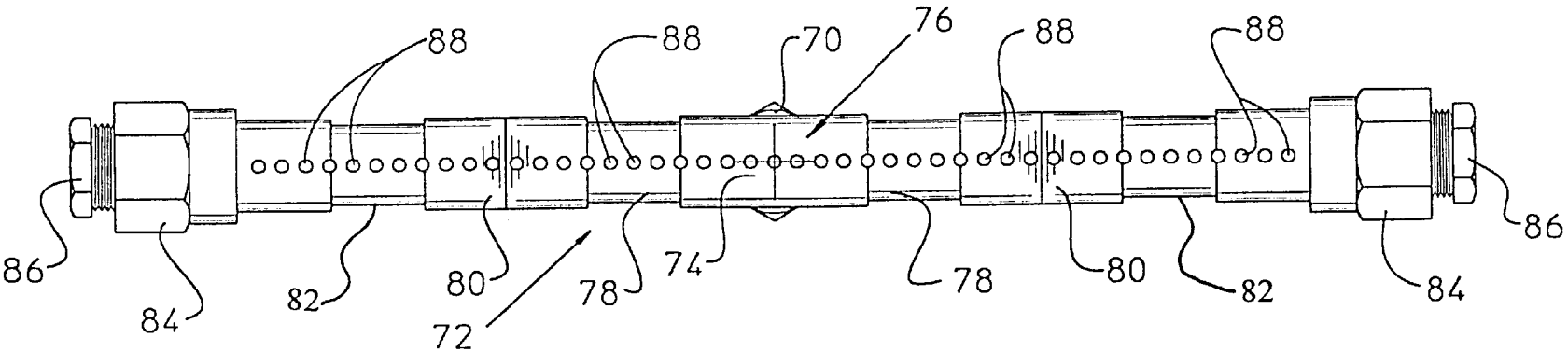
FIG. 6 is a view taken along lines VI—VI of FIG. 5.

According to the present invention the diverter valve 32 is also used to divert the entire flow of water from the water pool filter by the length of a flexible hose 52 to an elongated handle 70 of a rinsing wand 72, shown in FIGS. 5 and 6. The extended end of the handle 70 is joined by a tee 74 to a central area of a generally C-shaped manifold 76. First straight manifold sections 78 extend from the opposite ends of the tee 74 and are joined by 45° elbows 80 to second straight manifold sections 82. A threaded fitting 84 is joined to the terminal end of each of the second straight section 82 and receives a threaded plug 86 forming a water tight connection. This threaded connection allows removal of the threaded plug for cleaning debris from the manifold. The first straight manifold sections 78, second straight sections 82 and tee fittings 80 all contain an array of water discharge apertures 88 lying in a common plane for discharging streams of water into the area which is partially encompassed by the C-shaped configuration of the manifold. An example of suitable apertures is 41 apertures with a diameter of 0.078125" (5/64"). The streams of water emerging from the apertures in the second straight sections 82 are parallel but at a 45° angle to the parallel streams of water emerging from the apertures in the straight manifold section 78 and serve to hydraulically flush debris from the pleated filter fabric at angularly dispersed sites about the outer periphery of the water filter cartridge.

Figure 7:
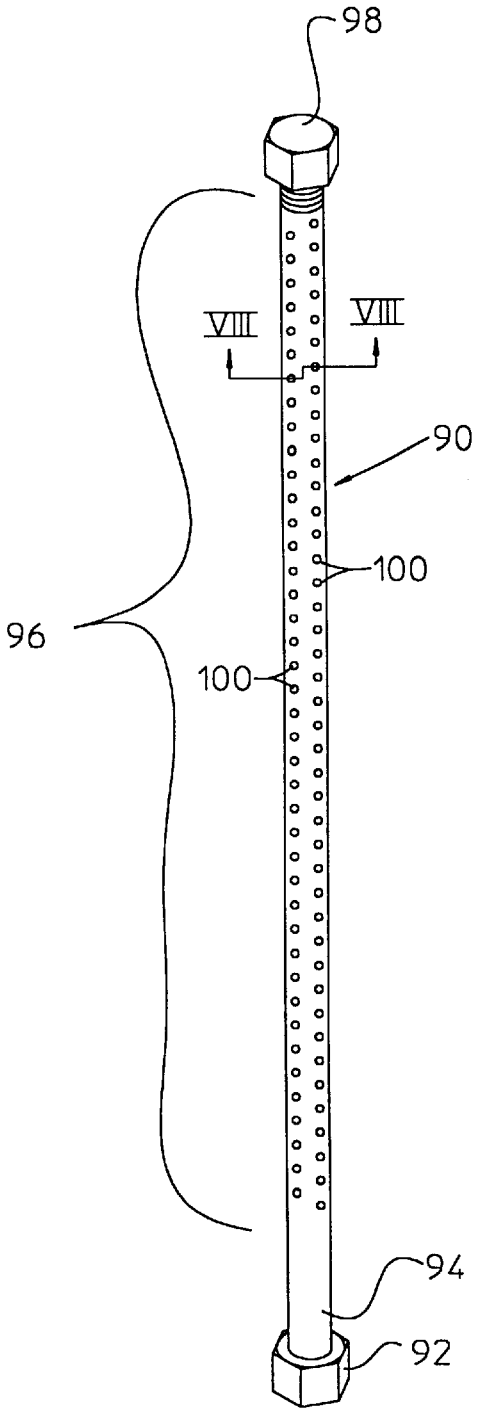
FIG. 7 is a plan view of a cleaning wand according to the present invention.
Figure 8:
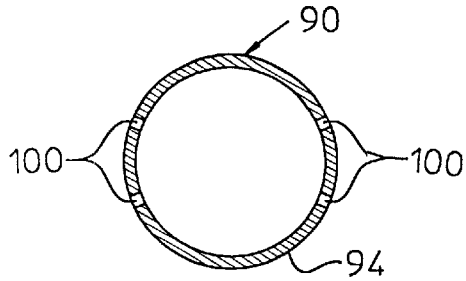
FIG. 8 is a sectional view taken along lines VIII—VIII.

The present invention further provides that the diverter valve 32 is also used to divert the entire flow of water from the pool filter to a cleaning wand 90 shown in FIGS. 7 and 8 and used for cleaning filter grids in water pool filters of commercial swimming pools. The filter grids are set along linear tracks at a closely spaced relation which is usually in the order of ¾". The cleaning wand 90 has a threaded connector 92 on a handle portion 94 for forming a water tight connection with the length of flexible hose 52. The handle portion 88 supplies the water flow in a coaxial direction with an axis extending along a linear flow duct inside a circular ring-shaped manifold 96 which is closed at its free end by a threaded connection with an end cap 98 in water tight fashion. This threaded connection allows removal of the end cap for cleaning debris from the manifold. An array of water discharge apertures 100 is arranged within two rows in parallel planes at diametrically opposite sides of the manifold to discharge streams of water from essentially only opposed sides of the manifold for impact with and hydraulically flush debris from the filter surfaces by a reverse flow of pool water as the manifold is moved in the space between the filter grids. An example of suitable apertures is 170 each with a diameter of 0.078125" (5/64"). The relatively large number of apertures in the cleaning wand 90 as compared with the apertures in the radius wand 58 and rinsing wand 72 is chosen not only to accommodate the extended length of the filter grids but also prevent an excessive water back pressure due to the closely spaced relation of the cleaning wand and the filter grids. The outside diameter of the manifold 96 must be chosen to allow a gap of 1/16" or less at opposite sides of the manifold.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. In a water filtering system having a pump coupled in piping configured to circulate water from a body of water in an open-topped structure, through a filter cartridge in one flow direction to a centrally located discharge chamber within said filter cartridge, and then back to said body of water, comprising in combination therewith:

a valve coupled in said piping between said pump and a filter housing of said filter cartridge, said valve having a first position wherein said filter housing receives the entire water output from said pump and a second position for diverting the entire water output of said pump from said filter housing;

a flexible conduit for receiving the entire water output from said pump when said valve is in said second position; and a first water discharge wand joined to said flexible conduit for receiving the water output from said conduit, said first water discharge wand having an elongated handle with an internal duct communicating with a circular ring-shaped manifold having an array of water discharge apertures, wherein said flexible conduit and said wand is configured to be manually manipulated such that said manifold can be positioned within said centrally located discharge chamber for directing streams of water radially outward into said filter cartridge in a direction opposite to said one flow direction to hydraulically flush debris from said filter cartridge using the entire pressurized water flow of said pump.

2. The combination according to claim 1 wherein said array of water discharge apertures are spaced about an entire periphery of said circular ring-shaped manifold for the discharge of streams of water onto an annular arrangement of fibrous filter media of said filter cartridge.

3. The combination according to claim 2 wherein said array of water discharge apertures lie in one plane.

4. The combination according to claim 2 wherein said circular ring-shaped manifold is elongated along an axis and joined in a coaxial relation with a central axis of said internal duct.

5. The combination according to claim 2 wherein said circular ring-shaped manifold includes a threaded aperture removably joined with threads on an end portion of said elongated handle for threaded disassembly to clean debris from the interior of said circular ring-shaped manifold.

6. The combination according to claim 2 wherein said circular ring-shaped manifold comprises a circular ring section having an outer diameter proximate the internal diameter of said centrally located discharge chamber.

7. The combination according to claim 1 wherein said array of water discharge apertures lie in rows at diametrically opposite sides of said circular ring-shaped manifold for discharging streams of water from essentially only two opposed sides of said circular ring-shaped manifold.

8. The combination according to claim 7 wherein said array of water discharge apertures lie in parallel planes.

9. The combination according to claim 7 wherein said circular ring-shaped manifold is elongated along an axis and joined in a coaxial relation with a central axis of said internal duct.

10. The combination according to claim 1 further including a second water discharge wand selectively joined to said flexible conduit, said second water discharge wand having an elongated handle with an internal duct communicating with a C-shaped manifold having an array of water discharge orifices for directing streams of water onto fibrous filter media of said filter cartridge in said one flow direction to hydraulically flush debris loosened by the water flow from said first water discharge wand using the entire pressurized water flow of the pump.

11. The combination according to claim 10 wherein said C-shaped manifold of said second water discharge wand comprises a generally straight manifold joined at each end with an angularly extending manifold.

12. The combination according to claim 11 wherein said angularly extending manifold at each end of said generally straight manifold extends at an angle of along a centrally located axis arranged perpendicular to a central axis of said internal duct of said second water discharge wand.

13. The combination according to claim 11 wherein each said angularly extending manifold includes an end having a removable end cap thereon for threaded disassembly to clear debris from the interior of said C-shaped manifold.

14. The combination according to claim 11 wherein each of said angularly extending manifolds extend at an angle of 45° from said generally straight manifold and wherein said generally straight manifold and each angularly extending manifold includes said water discharge orifices aligned in an array such that streams of water emerging from the apertures in the angularly extending manifold are parallel but at a 45° angle to the parallel streams of water emerging from the apertures in said generally straight manifold section to flush debris from said filter cartridge at angularly dispersed sites about the outer periphery thereof.

15. The combination according to claim 1 wherein said valve comprises a three-way valve.

16. The combination according to claim 1 wherein said valve comprises an inline valve operable to allow and prevent the flow of water to said filter housing and wherein said combination further includes a tee fitting coupled in said piping between said pump and said inline valve for providing a diverted flow of water to said flexible conduit via a first branch of said tee fitting, said first branch being normally closed by a removable end cap to block said diverted flow of water when said inline valve is positioned to allow the flow of water to said filter housing via a second branch of said tee.

* * * * *